US006941873B1

(12) United States Patent
Holmgren

(10) Patent No.: US 6,941,873 B1
(45) Date of Patent: Sep. 13, 2005

(54) TANK STEAM-OUT CAP

(75) Inventor: Peter V. Holmgren, Fairbanks, AK (US)

(73) Assignee: Flint Hills Resources, LLC, Wichita, KS (US)

( * ) Notice: Subject to any disclaimer, the term of this patent is extended or adjusted under 35 U.S.C. 154(b) by 0 days.

(21) Appl. No.: 10/224,714

(22) Filed: Aug. 21, 2002

(51) Int. Cl.[7] ..... B61D 5/00
(52) U.S. Cl. ..... 105/358; 103/360; 137/240; 406/109; 165/86
(58) Field of Search ..... 105/358, 360; 137/240, 241, 203; 134/166 R, 167 R, 169 R; 406/109, 129, 136, 137, 144, 146

(56) References Cited

U.S. PATENT DOCUMENTS

| | | | | |
|---|---|---|---|---|
| 868,130 A | | 10/1907 | Russell | |
| 2,565,156 A | | 8/1951 | Wexler | 137/21 |
| 3,228,466 A | * | 1/1966 | Carleton | 165/169 |
| 3,319,709 A | * | 5/1967 | Strunk | 165/86 |
| 4,110,602 A | | 8/1978 | McDade | 219/523 |
| 4,141,535 A | | 2/1979 | Reedy et al. | 251/144 |
| 4,150,700 A | * | 4/1979 | Fox, Jr. | 141/11 |
| 4,457,324 A | * | 7/1984 | Schepper | 134/102.1 |
| 4,554,966 A | | 11/1985 | Vasiliev et al. | 165/104.21 |
| 4,651,817 A | * | 3/1987 | Dugger et al. | 165/86 |
| 4,717,120 A | | 1/1988 | Fremow et al. | 251/144 |
| 4,745,947 A | * | 5/1988 | Rehbein | 137/340 |
| 4,867,073 A | | 9/1989 | Dugge | 105/358 |
| 5,330,154 A | | 7/1994 | Mashburn et al. | 251/144 |
| 5,419,347 A | * | 5/1995 | Carruth | 134/57 R |
| 6,164,380 A | * | 12/2000 | Davis | 166/312 |
| 6,345,631 B1 | * | 2/2002 | Brunson | 134/22.1 |

OTHER PUBLICATIONS

Declaration of Events Related to Applicant's Invention, signed by inventor.

* cited by examiner

*Primary Examiner*—Frantz F. Jules
(74) *Attorney, Agent, or Firm*—Fellers, Snider, Blankenship, Bailey & Tippens, P.C.

(57) ABSTRACT

A steam cap for use in cleaning out a tank, such as a railroad tank car, is described herein. The steam cap of the invention is preferably affixed to a tank outlet, such as a tanker outlet leg. The steam cap includes a body, preferably made of a drain cup and a line cuff, wherein the body is adapted to be secured to the tank. A delivery pipe extends into an interior space defined by the body. The drain cup defines an annular space around the delivery pipe. A condensate drain line communicates with the annular space. The condensate drain line extends outwardly from the drain cup. In use, steam or other material, delivered to the tank through the delivery pipe condenses on the tank walls and collects at a bottom of the tank. The condensate drains out of the tank outlet into the annular space in the drain cup. Condensate is then drained out of the annular region of the interior space through the condensate drain line or through a perforation. The condensate may be drained out of the annular space simultaneous to delivery of steam through the delivery pipe, which is advantageous in reducing time required to clean a tank.

13 Claims, 3 Drawing Sheets

TANK STEAM-OUT CAP

BACKGROUND OF THE INVENTION

1. Field of the Invention

This invention relates generally to a steam out cap for affixing to a tank and more particularly to a steam out cap for use with a railroad tank car.

2. Background

Rail tank cars and other types of tanks require periodic cleaning. With respect to rail cars in particular, such cars are often provided with an outlet leg on an underside of the rail car. One method of cleaning out a tank is by injecting steam or other vapors or liquids inside the tank. When vapors are used, condensate forms on the walls of the tank and then collects, along with the material being cleaned out of the tank, in a lower area of the tank.

Devices generally referred to as steam caps have been affixed to the outlet leg of a tank. The steam caps provide a method of connecting a steam line to a rail car. A problem with existing steam caps is that once condensate collects in the lower areas of a tank, incoming steam is required to pass through the condensate, which cools the steam. Consequently, multiple disengagements of the steam cap from the car must be undertaken to drain the collected condensate from within the tank.

Therefore, a steam cap that allows for simultaneous draining of condensate from inside of the tank and injection of steam or other cleaning agents into the tank is desirable.

SUMMARY OF THE INVENTION

According to the present invention there is provided an improvement in a steam cap for use in injecting steam for purposes of cleaning out a tank, such as a railroad tank car. The steam out cap of the invention allows steam to be delivered to a tank for cleaning, while simultaneously allowing the draining of condensate from inside the tank. Draining of the condensate allows the steam to enter the tank without having to pass through a pool of accumulated condensate. Additionally, because the condensate can drain from the tank while the cleaning operation is in progress, the necessity of repeatedly removing a steam cap from the tank to drain the condensate is eliminated. The result is a substantial reduction in the time required to clean a tank.

The steam cap of the invention is preferably affixed to a tank outlet, such as a tanker outlet leg. The steam cap includes an annular drain cup adapted to be secured to the tanker outlet leg with fasteners such as cam locks. A line cuff is affixed to a lower end of the annular drain cup with fasteners. The annular drain cup and the line cuff define an interior space. A delivery pipe is preferably attached to the steam cuff and extends into the interior space, terminating at an upper or exit end in the tanker outlet leg or in the body of the steam line cap. The annular drain cup defines an annular space around the delivery pipe. A condensate drain line is provided to drain condensate from the annular space. The condensate drain line extends outwardly from the annular drain cup.

In use, the annular drain cup is affixed to a tanker outlet leg with fasteners. A delivery pipe is inserted within the interior space and the steam cuff with attached delivery pipe is affixed to a lower surface of the annular drain cup. When steam is delivered through the delivery pipe, condensate forms in the tank and collects in the bottom of tank. Condensate then drains into the annular region of the interior space that surrounds the delivery pipe and drains out through the condensate drain line. The space between the delivery pipe and the body, i.e. the annular drain cup and the steam line cuff, allows the condensate to drain simultaneously with respect to the injection of steam from the delivery pipe.

A better understanding of the present invention, its several aspects, and its advantages will become apparent to those skilled in the art from the following detailed description, taken in conjunction with the attached drawings, wherein there is shown and described the preferred embodiment of the invention, simply by way of illustration of the best mode contemplated for carrying out the invention.

DETAILED DESCRIPTION OF THE PREFERRED EMBODIMENT

Before explaining the present invention in detail, it is important to understand that the invention is not limited in its application to the details of the embodiments and steps described herein. The invention is capable of other embodiments and of being practiced or carried out in a variety of ways. It is to be understood that the phraseology and terminology employed herein is for the purpose of description and not of limitation.

Figure 1:
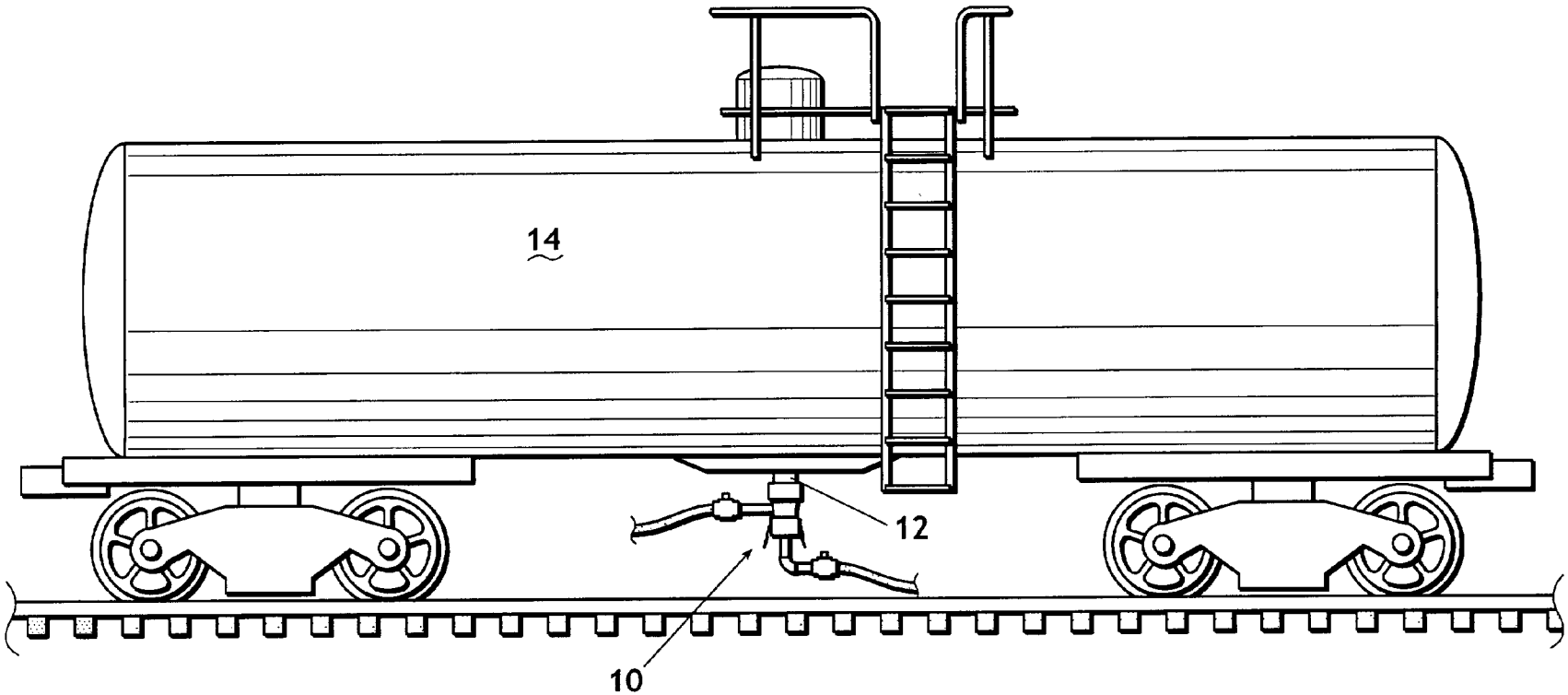
FIG. 1 is a schematic drawing of the steam-out cup of the invention affixed to a tanker outer leg.
Figure 2:
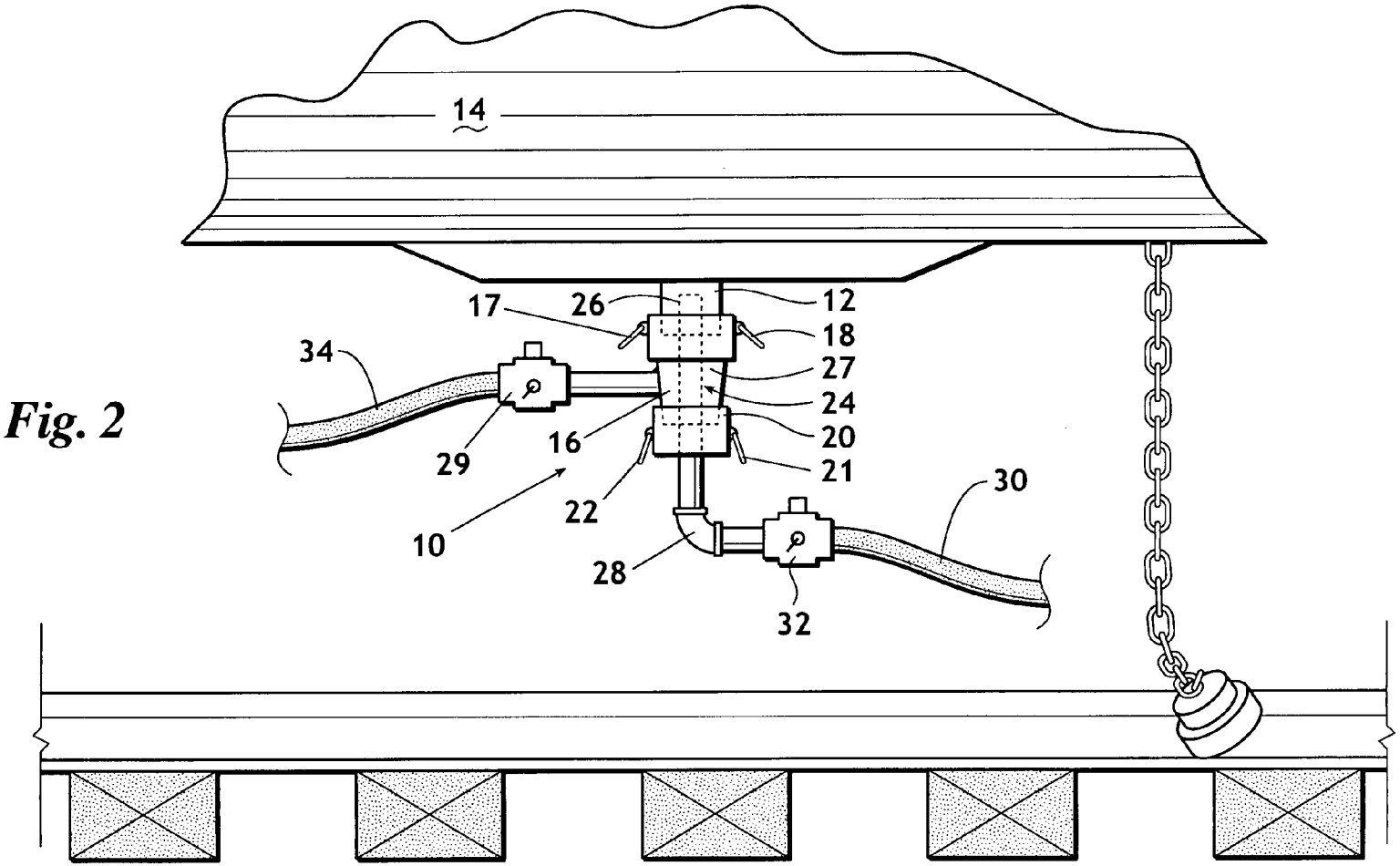
FIG. 2 is an enlarged schematic drawing of the steam-out cap of the invention affixed to a tanker outer leg, with internal components shown with dashed lines.

Referring now to FIGS. 1 and 2, a steam out cap is designated generally 10. Steam out cap 10 is preferably affixed to a tanker outlet leg 12 of a tank 14. Tank 14 may be a rail car tank or other types of tanks. Referring now particularly to FIG. 2, the steam out cap 10 has an annular drain cup 16 adapted to be secured to the tanker outlet leg 12. In one embodiment the annular drain cup 16 is secured to the tanker outlet leg 12 with fasteners designated generally 17. One embodiment uses cam locks 18 to affix annular drain cup 16 to tanker outlet leg 12. However, other fasteners 17 may be used including threads, pins, quick release couplings, or other removable fasteners. Additionally, annular drain cup 16 may be permanently attached to line cuff 20, e.g. by welding, forming from a single piece or by other methods. The annular drain cup 16 preferably has a large diameter at an upper end, e.g. 4", for engaging the tanker outlet leg 12 and a smaller diameter, e.g. 3", at a lower end. In one embodiment, line cuff 20 is affixed to the annular drain cup 16 with fasteners 21, such as cam locks 22. However, other methods may be used as explained above in reference to fasteners 17.

Together the annular drain cup 16 and the line cuff 20 make up a body that defines an interior space 24. A delivery pipe 26 extends into interior space 24. Preferably, delivery pipe 26 extends through the line cuff 20 and through the annular drain cup 16 into the tanker outlet leg 12. Delivery pipe 26 is preferably has a substantially smaller diameter than tanker outlet leg 12 to allow fluids to drain into the annular drain cup 16 while steam is being emitted from delivery pipe 26. In a preferred embodiment, the delivery pipe 26 is affixed, e.g. welded, to the line cuff 20. Therefore, when line cuff 20 is installed on the lower end of the annular drain cup 16, the delivery pipe 26 is inserted in the annular drain cup 16. After delivery pipe 26 is extended into interior space 24, an annular space 27 is defined around delivery pipe 26 inside of line cuff 20 and annular drain cup 16. A pipe fitting 28, such as a 90° elbow, may be affixed to a lower end of delivery pipe 26. A inlet line 30 communicates with the pipe fitting 28. Inlet line 30 preferably is provided with a steam inlet valve 32.

Figure 3:
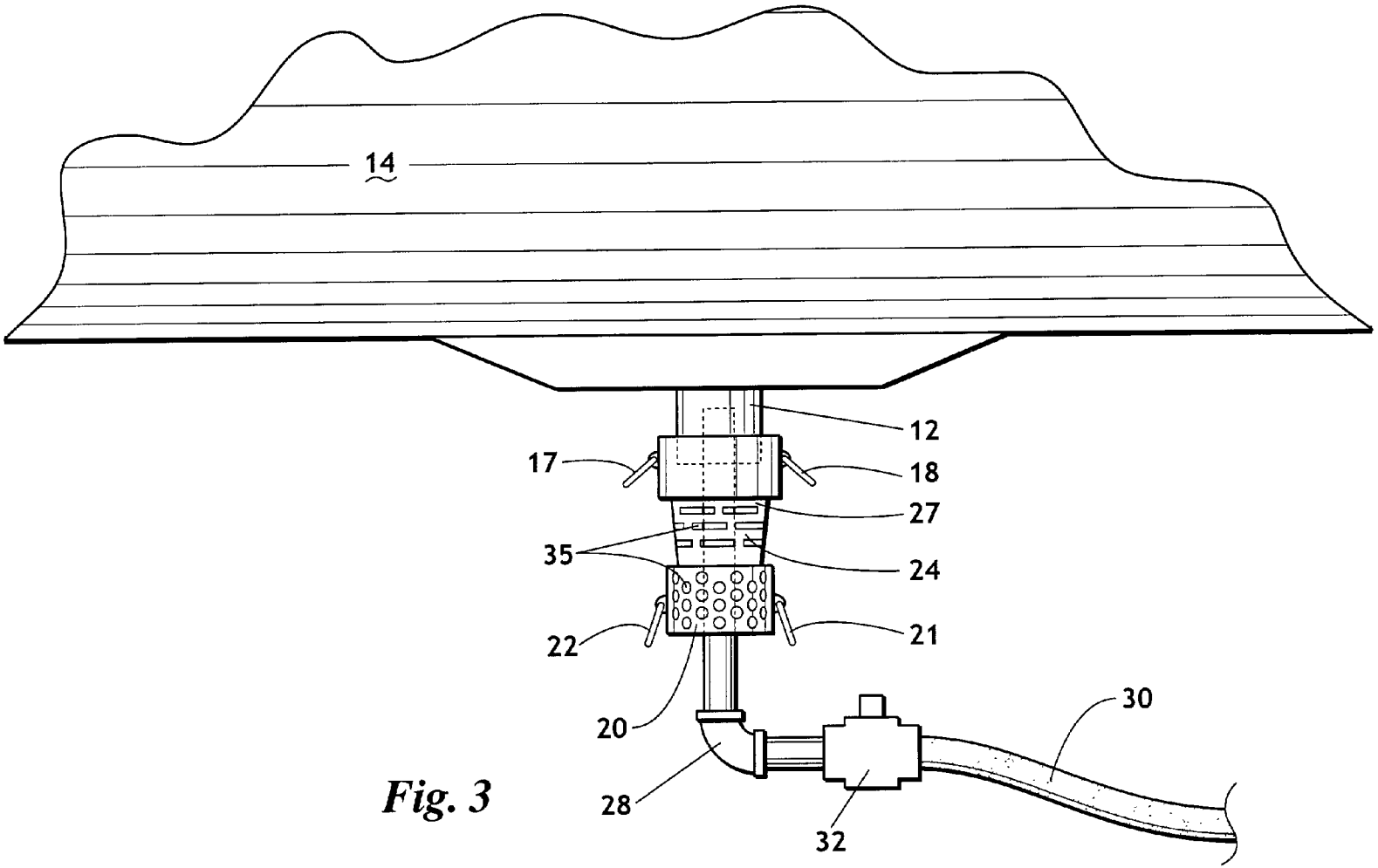
FIG. 3 is an enlarged schematic drawing of an alternate embodiment of a steam out cap, with internal components shown with dashed lines.

A condensate drain line 34 is provided that is in communication with annular space 27. Condensate drain line 34 is preferably welded to the annular drain cup 16. Preferably, condensate drain line 34 is attached to the steam out cup 10 at a location below the upper end of delivery pipe 26, which allows for draining of condensate from interior space 24 before condensate interferes with steam emissions from delivery pipe 26. Most preferably, condensate drain line 34 is affixed to annular drain cup 16. However, condensate drain line 34 may be provided at any location that allows condensate to drain out of annular space 27. A condensate valve 29 is provided to control flow through condensate drain line 34. Alternatively, annular drain cup 16 and/or line cuff 20 may be provided with perforations 35 (FIG. 3) to allow condensate to flow out of interior space 24.

In use, the steam out cap 10 is affixed to the tanker outlet leg 12 of tank 14. Fasteners 17 may be used to removably affix the annular drain cup 16 to the tanker outlet leg 12. Line cuff 20 is affixed to the lower end of the annular drain cup 16 with fasteners 21. The delivery pipe 26 is extended into interior space 24. The upper end of delivery pipe 26 preferably extends into the tanker outlet leg 12. However, the steam pipe 26 may extend into tank 14, or only into the annular drain cup 16, as desired. Additionally, the delivery pipe 26 is preferably extended into interior space 24 when the line cuff 20 is affixed to the annular drain cup 16. A suitable pipe fitting 28, such as a 90° elbow, is affixed to a lower end of delivery pipe 26. A inlet line 30 is affixed to delivery pipe 26 and includes a steam inlet valve 32 located thereon. Steam is then injected into the inlet line 30. Steam passes through inlet line 30, through fitting 28 and up through delivery pipe 26 where the steam exits, either passing through the tanker outlet leg 12 or passing directly into the tank 14.

Steam within the tank 14 will eventually form condensation that will collect at a lower portion of the tank 14. The condensate will then drain out of the tank 14 through tanker outlet leg 12. The condensate exiting tank 14 through tanker outlet leg 12 drains into the annular space 27 in the annular drain cup 16 and line cuff 20 surrounding steam pipe 26. By draining into the annular space 27 surrounding the delivery pipe 26, the condensate does not obstruct entry of the steam into the tank 14. Once condensate drain line 34 is open, the condensate is able to drain out of annular space 27 through the condensate drain line 34. Alternatively, condensate may drain out of perforations 35 onto the ground. Due to the design of the steam out cup 10, draining of condensate out of condensate drain line 34 or through perforations 35 is able to take place simultaneously with the injection of steam through the delivery pipe 26.

It should be noted that although "steam" and "condensate" have been used in the specification, the invention is not intended to be limited for use only with steam and the condensate resulting therefrom. For purposes of this invention, "steam" shall refer to vapors and liquids, which may be used for tank cleaning, while "condensate" shall refer, not only to condensate resulting from said vapors, but also to any material that must be drained from the interior of the tank during the cleaning operation.

While the invention has been described with a certain degree of particularity, it is understood that the invention is not limited to the embodiment(s) set for herein for purposes of exemplification, but is to be limited only by the scope of the attached claim or claims, including the full range of equivalency to which each element thereof is entitled.

What is claimed is:

1. A steam out cap for affixing to a tank outlet of a railroad tank car, comprising:

a body defining an interior space said body adapted for communicating with the tank outlet of the railroad tank car;

a delivery pipe extending into said interior space, said delivery pipe having a smaller diameter than said tank outlet and defining an annular space between said body and said delivery pipe in said interior space, said delivery pipe for injecting material into the tank;

a drain cup for receiving condensate from the tank;

a line cuff affixed to a lower end of said drain cup for containing condensate within said body; and wherein said annular space receives condensate draining past said delivery pipe thereby permitting an unimpeded flow of material from said delivery pipe into the tank.

2. The steam out cap according to claim 1 wherein:

said line cuff is removably affixed to said drain cup.

3. The steam out cap according to claim 1 wherein:

an upper end of said delivery pipe extends above said body.

4. The steam out cap according to claim 1 wherein:

an upper end of said delivery pipe is located within said body.

5. The steam out cap according to claim 1 wherein:

said delivery pipe is affixed to said line cuff.

6. The steam out cap according to claim 1 further comprising:

a condensate drain line in communication with said annular space, said condensate drain line for transferring condensate away from the tank outlet of said railroad tank car.

7. The steam out cap according to claim 6 wherein:

said condensate drain line protrudes from said body.

8. A steam out cap for affixing to a tank outlet of a railroad tank car, comprising:

a body defining an interior space, said body adapted for communicating with the tank outlet of the railroad tank car;

a delivery pipe extending into said interior space, said delivery pipe having a smaller diameter than said tank outlet and defining an annular space between said body and said delivery pipe in said interior space, said delivery pipe for injecting material into the tank; and wherein said annular space receives condensate draining past said delivery pipe thereby permitting an unimpeded flow of material from said delivery pipe into the tank;

a condensate drain line in communication with said annular space, said condensate drain line for transferring condensate away from the tank outlet of said railroad tank car;

said body comprises a drain cup for receiving condensate from the tank and a line cuff for containing condensate within said body; and said condensate drain line protrudes from said drain cup.

9. The steam out cap according to claim 8 wherein:

said body defines an outlet for draining condensate out of said tank outlet of said railroad tank car through said annular space.

10. A tank style railroad car having an outlet and a steam out cap affixed thereto, said combination comprising:

a drain cup adapted to be secured to the outlet;

a line cuff affixed to a lower end of said drain cup;

wherein said drain cup and said line cuff define an interior space;

a delivery pipe extending into said interior space; and a condensate drain line affixed to said drain cup at a location below an upper end of said delivery pipe, said condensate drain line in communication with said interior space.

11. A steam out cap comprising:

a body defining an interior space, said body adapted for communicating with the tank outlet for affixing to a tank outlet of a railroad tank car;

a delivery pipe extending into said interior space, said delivery pipe having a smaller diameter than said tank outlet and defining an annular space between said body and said delivery pipe in said interior space, said delivery pipe for injecting material into the tank;

wherein said annular space receives condensate draining past said delivery pipe thereby permitting an unimpeded flow of material from said delivery pipe into the tank;

a condensate drain line in communication with said annular space, said condensate drain line for transferring condensate away from the tank outlet; and wherein said body comprises a drain cup for receiving condensate from the tank and a line cuff for containing condensate within said body; and said condensate drain line protrudes from said drain cup.

12. A method of cleaning out a railroad tank car comprising the steps of:

affixing a body to a tank outlet of the railroad tank car;

injecting material through said body into the tank through a delivery pipe;

draining condensate from said tank into said body simultaneous to said step of injecting material, whereby said condensate is prevented from interfering with an exit of material from said delivery pipe; and wherein said step of draining condensate from said tank into said body comprises draining said condensate through perforations in said body.

13. The method according to claim 12 wherein said step of draining condensate from said tank into said body comprises directing said condensate into a condensate drain line.

* * * * *